US009115632B2

(12) United States Patent
Wolfcarius et al.

(10) Patent No.: US 9,115,632 B2
(45) Date of Patent: Aug. 25, 2015

(54) EXHAUST STACK PIPE COVER

(75) Inventors: Nico Wolfcarius, Wakken (BE); Carlo De Marco, Modena (IT)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 14/007,052

(22) PCT Filed: Mar. 21, 2012

(86) PCT No.: PCT/EP2012/054987

§ 371 (c)(1), (2), (4) Date: Mar. 5, 2014

(87) PCT Pub. No.: WO2012/126942

PCT Pub. Date: Sep. 27, 2012

(65) Prior Publication Data

US 2014/0182718 A1 Jul. 3, 2014

(30) Foreign Application Priority Data

Mar. 24, 2011 (IT) ..... TO2011A0256

(51) Int. Cl.
*F01N 3/02* (2006.01)
*F01N 13/08* (2010.01)

(52) U.S. Cl.
CPC ..... *F01N 13/08* (2013.01); *F01N 13/082* (2013.01); *F01N 13/085* (2013.01); *F01N 2240/20* (2013.01); *F01N 2470/00* (2013.01); *F01N 2470/30* (2013.01); *F01N 2590/08* (2013.01); *Y10T 137/85938* (2015.04)

(58) Field of Classification Search
CPC ..... F01N 13/082; F01N 13/085; F01N 13/08; F01N 2240/20; F01N 2470/00; F01N 2470/30; F01N 2590/08
See application file for complete search history.

(56) References Cited

U.S. PATENT DOCUMENTS

| | | | | | |
|---|---|---|---|---|---|
| 1,217,615 | A * | 2/1917 | Rowland | 181/262 |
| D135,040 | S * | 2/1943 | McDowell | D23/376 |
| 2,732,913 | A | 1/1956 | Higgins | |
| 3,792,722 | A * | 2/1974 | Harmon | 138/108 |
| 4,106,290 | A * | 8/1978 | Johnson | 60/324 |
| 4,387,915 | A * | 6/1983 | Adickes | 285/330 |
| 4,487,289 | A * | 12/1984 | Kicinski et al. | 181/252 |
| 5,170,020 | A | 12/1992 | Kruger et al. | |
| 7,207,172 | B2 * | 4/2007 | Willix et al. | 60/317 |
| 7,347,044 | B1 | 3/2008 | Lubenow et al. | |
| 8,286,422 | B2 * | 10/2012 | Yang et al. | 60/317 |
| 8,661,803 | B2 * | 3/2014 | Sponsky et al. | 60/324 |
| 2006/0157296 | A1 * | 7/2006 | Belisle | 181/234 |

* cited by examiner

*Primary Examiner* — Jesse Bogue
(74) *Attorney, Agent, or Firm* — Sue C. Watson

(57) ABSTRACT

A cover for the upper end of an exhaust stack pipe comprises a curved cover pipe of greater diameter than the stack pipe. The curved cover pipe has a proximal end to fit over the end of the stack pipe and a distal end from which exhaust gases are discharged. The cover pipe is shaped to prevent rain from falling directly onto the end of the stack pipe. A flow diverter of lesser diameter than the cover pipe is mounted within the proximal end of the cover pipe to overlie the end of the stack pipe. The flow diverter comprises an extension tube for mounting onto the end of the stack pipe having lateral openings and a tapering deflector extending into the extension tube to divert exhaust gases to flow into the cover pipe through the lateral openings in the extension tube.

8 Claims, 1 Drawing Sheet

EXHAUST STACK PIPE COVER

CROSS REFERENCE TO RELATED APPLICATIONS

This application is the US National Stage filing of International Application Serial No. PCT/EP2012/054987, entitled "EXHAUST STACK PIPE COVER", filed Mar. 21, 2012, which claims priority to Italian Application Serial No. TO2011A000256, filed Mar. 24, 2011, each of which is incorporated by reference herein in its entirety for all purposes.

FIELD OF THE INVENTION

The present invention relates to a cover for the upper end of an exhaust stack pipe to prevent ingress of water into the stack pipe.

BACKGROUND OF THE INVENTION

It is common for commercial and agricultural vehicles, such as tractors and harvesters, to use a vertical stack pipe for the engine exhaust. It is also known to provide sensors, such as $NO_x$ or lambda sensors, within vehicle exhaust pipes to monitor the contents of the exhaust gases, the output signals of such sensors being used by the engine management system. A problem that arises when an exhaust stack pipe is fitted with a sensor is that water ingress can damage the sensor caused for instance by the large temperature difference between the water and the sensor in working conditions. Water ingress may further also generate a false read-out of a sensor. Steps need to be taken to prevent rain or other precipitation from penetrating into the stack pipe.

Hitherto, this has been achieved by placing a flat cover over the end of the stack pipe. Such an arrangement is described, for example, in U.S. Pat. No. 7,347,044 in the context of a vertical exhaust water trap assembly having an outer housing and an internal housing or exhaust tube defining an annular water collection spaced therebetween bypassing a central exhaust flow area. However, such an obstruction in the path of the exhaust gases creates a backpressure within the exhaust system which reduces engine performance and efficiency. An increased backpressure is critical for vehicles equipped with an exhaust aftertreatment system. Due to the reduced speed of the exhaust gases the temperature in these aftertreatment systems increase and components may be damaged permanently, resulting in high warranty and maintenance costs.

OBJECT OF THE INVENTION

The present invention seeks therefore to provide a cover for the upper end of an exhaust stack pipe that effectively prevents ingress of water while minimising backpressure within the exhaust system.

SUMMARY OF THE INVENTION

According to a first aspect of the present invention, there is provided an exhaust stack pipe having and upper end and lateral openings adjacent the upper end, a curved cover pipe of greater diameter than the stack pipe overlying the lateral openings and shaped to prevent rain from falling directly onto the upper end of the stack pipe, and a flow diverter of lesser diameter than the cover pipe mounted within the cover pipe to overlie the end of the stack pipe, the flow diverter comprising a tapering deflector extending into the stack pipe to divert exhaust gases to flow into the cover pipe through the lateral openings in the stack pipe. Preferably, the lateral openings in the extension tube are downwardly tapering cut-outs, being narrower at their proximal ends than at their distal ends.

The tapering deflector may be pyramidal but it is preferred for it to be of circular cross section. While it is furthermore convenient, for ease of manufacture, to form the pyramidal or conical deflector with straight sides (when viewed in an axial section) it possible for the sides to be curved, in particular inwardly concave.

By virtue of its construction, the diverter serves to deflect the exhaust gases to flow smoothly out of the stack pipe into the annular space between the extension tube and the larger curved cover pipe to be discharged from the distal end of the cover pipe. The smooth flow avoids backpressure in the exhaust stack pipe while the cover pipe and the tapering deflector effectively prevent rain from entering the stack pipe.

In an embodiment of the invention, a baffle plate extends between the proximal ends of the extension tube and the cover pipe to ensure that exhaust gases are discharged only from the distal end of the cover pipe. Drainage holes may be provided in the baffle plate for any water that collects on the inner surface of the cover pipe.

Preferably, a tray is provided to cover the upper end of the deflector and drainage spouts are provided around the circumference of the tray to allow water falling on the tray to drip onto the baffle plate.

It is also known to provide a flow restrictor within an exhaust stack to act as a venturi for creating a negative pressure in a pipe that draws air into the exhaust stack pipe from the engine intake air filter. Such an arrangement is used to help prolong the life of the intake air filter.

In an embodiment of the invention, drainage holes are formed in the exhaust stack pipe around such a flow restrictor. If water should condense on the section of the exhaust stack pipe downstream of the flow restrictor then such water can flow safely out of the drainage hole, the restrictor acting as a barrier to prevent the water from running down the inside surface of the exhaust stack towards a sensor.

As an alternative to integrating the cover into the design of the exhaust stack pipe, the invention may be implemented by attaching a cover to the upper end of a conventional stack pipe.

Thus, in accordance with a second aspect of the invention, there is provided a cover for the upper end of an exhaust stack pipe comprising a curved cover pipe of greater diameter than the stack pipe having a proximal end to fit over the end of the stack pipe and a distal end from which exhaust gases are discharged, the cover pipe being shaped to prevent rain from falling directly onto the end of the stack pipe, and a flow diverter of lesser diameter than the cover pipe mounted within the proximal end of the cover pipe to overlie the end of the stack pipe, the flow diverter comprising an extension tube for mounting onto the end of the stack pipe having lateral openings and a tapering deflector extending into the extension tube to divert exhaust gases to flow into the cover pipe through the lateral openings in the extension tube.

It is common for an exhaust stack pipe to be fitted with a heat shield that surrounds the stack pipe over at least the majority of its circumference. The cover pipe in the present invention may conveniently be formed of the same diameter as such a heat shield to appear as a curved extension of the heat shield.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
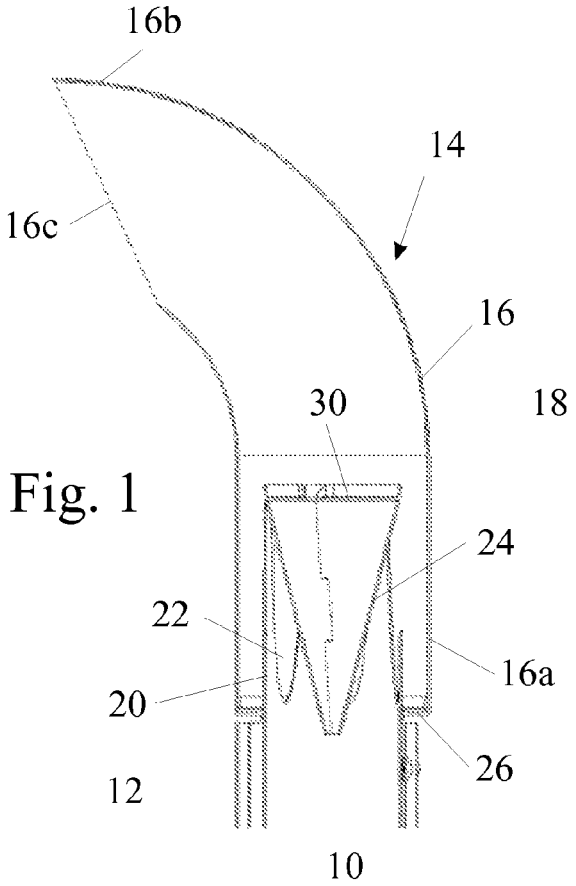
FIG. 1 is a section through the upper end of an exhaust stack pipe fitted with a cover.

FIG. 1 shows a vertical exhaust stack pipe 10 surrounded by a heat shield 12 that surrounds the stack pipe over slightly less than its entire circumference and a cover, generally designated 14, fitted over the top of the stack pipe 10. The cover 14 comprises a curved pipe 16 having the same diameter as the heat shield 12 that bends through approximately 90° and has a proximal end 16*a* that is fitted over the stack pipe 10 and a distal end 16*b* with an undercut discharge opening 16*c* so that rain cannot drop vertically into the cover pipe 16.

Figure 3:
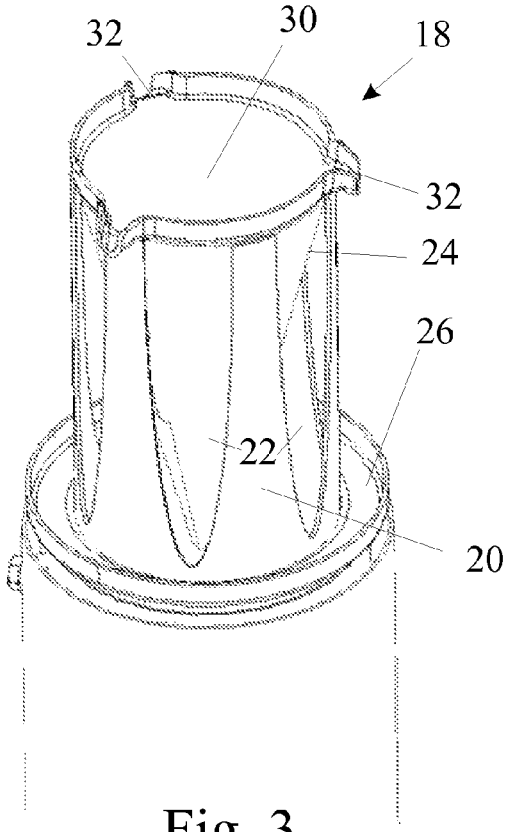
FIG. 3 is a perspective view of flow diverter disposed with the cover of FIG. 1.
Figure 4:
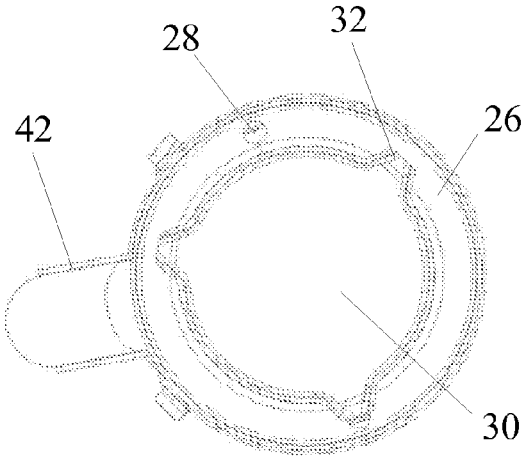
FIG. 4 is a plan view from above of the flow diverter shown in FIG. 3.

A flow diverter 18 is disposed within the proximal end of the cover pipe 16. The flow diverter 18, which is shown more clearly in FIGS. 3 and 4, comprises an extension tube 20 of the same diameter as the stack pipe formed around it circumference with U-shaped or V-shaped cut-outs 22. In an alternative embodiment in which the cover 14 is integrated into the stack pipe, the tube 20 is constituted by the end of the stack pipe rather than by an extension secured to the end of the stack pipe.

A conical straight-sided deflector 24 extends downwards into the extension tube 20 to approximately the same level as the lower tips of the cut-outs 22. The upper end of the deflector 24 is covered by a tray 30 that has drip spouts 32 distributed about its periphery.

A baffle plate 26 extends between the proximal ends of the curved cover pipe 16 and the extension tube 20. The baffle plate ensures that exhaust gases are discharged from the distal rather than the proximal end of curved pipe 16. Water that condenses on the curved pipe 16 or that somehow finds its way onto the tray 30 and drip offs the spouts 32 onto the baffle plate 26 can escape through drainage holes 28 in the baffle plate 26 (see FIG. 4) to fall into the space between the stack pipe 10 and the heat shield 12.

Figure 2:
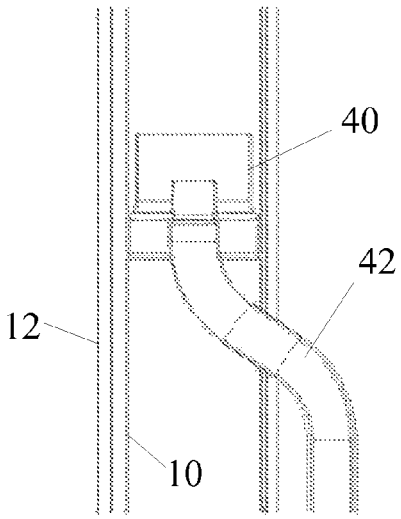
FIG. 2 is a section through a part of the exhaust stack pipe of FIG. 1 disposed further upstream.

Prior to reaching the upper end of the stack pipe 10, the exhaust gases passes through a flow restrictor shown in FIG. 2. The flow restrictor 40 is in the form of a ring secured to the interior surface of the stack pipe that is shaped as a venturi to create a reduced pressure at the mouth of a suction pipe 42. The pipe 42 passes through the wall of the stack pipe 10 and the heat shield and draws air from the engine intake air filter.

The curved cover pipe 16 prevents most rain water from reaching the upper end of the stack pipe. Any rain water that may be blown will fall on the inner surface of the curved pipe 16 or possibly on the tray 30. In either case, water will find its way under gravity to the baffle plate 26 from which it will escape through the drainage holes 28. In this way, no rain water can reach the interior of the stack pipe and find its way onto a sensor disposed within the stack pip 10.

Despite this effective preventing of water entering the stack pipe, the cover offers minimal resistance to the discharge of exhaust gases and therefore does not create a high exhaust backpressure. In particular, the exhaust gases are diverted by the deflector 24 to flow evenly through the cut-outs 22 into the annular space between the diverter 18 and the interior of the curved pipe 16.

A further, second stage water trap is available to avoid contact of the sensor with water. Should any water from the exhaust gases condense on the inner surface of the stack pipe above the venturi flow restrictor 40, it will reach the annular channel between the flow restrictor 40 and the inner surface of the stack pipe 10. Further drainage holes in this channel (not shown) allow such water to flow out into the gap between the stack pipe 10 and the heat shield 12.

It is an advantage of the invention that the cover pipe 16 is aesthetically pleasing by appearing as an extension of the heat shield 12. Furthermore, all drainage takes place into the annular gap between the stack pipe and the heat shield so that the appearance of the stack pipe is not marred.

The invention claimed is:

1. An exhaust stack pipe, comprising:

a stack pipe including an upper end and lateral openings adjacent the upper end, a curved cover pipe of greater diameter than the stack pipe overlying the lateral openings and shaped to prevent rain from falling directly onto the upper end of the stack pipe, a heat shield surrounding the stack pipe over at least the majority of its circumference, wherein the cover pipe is formed of the same diameter as such a heat shield, a flow diverter of lesser diameter than the cover pipe mounted within the cover pipe to overlie the end of the stack pipe, the flow diverter comprising an extension tube for mounting onto the end of the stack having lateral openings in the extension tube which are downwardly tapering cutouts, a tapering deflector extending into the stack pipe to divert exhaust gases to flow into the cover pipe through the lateral openings in the stack pipe, the tapering deflector a straight-sided cone of circular cross section, a baffle plate extending between the proximal end of the cover pipe and the exhaust stack pipe to ensure that exhaust gases are discharged only from the distal end of the cover pipe, wherein drainage holes are provided in the baffle plate for any water that collects on the inner surface of the cover pipe, a tray to cover the upper end of the deflector and drainage spouts provided around the circumference of the tray to allow water falling on the tray to drip onto the baffle plate, and a flow restrictor provided within the exhaust stack upstream of the cover pipe to act as a venturi, wherein drainage holes are formed in the exhaust stack pipe around the flow restrictor.

2. The exhaust stack pipe as claimed in claim 1, wherein the lateral openings in the extension tube are downwardly tapering cut-outs.

3. The exhaust stack pipe as claimed in claim 1, wherein the tapering deflector is a straight-sided cone of circular cross section.

4. The exhaust stack pipe as claimed in claim 1, wherein a baffle plate extends between the proximal end of the cover pipe and the exhaust stack pipe to ensure that exhaust gases are discharged only from the distal end of the cover pipe.

5. The exhaust stack pipe as claimed in claim 4, wherein drainage holes are provided in the baffle plate for any water that collects on the inner surface of the cover pipe.

6. The exhaust stack pipe as claimed in claim 5, wherein a tray is provided to cover the upper end of the deflector and drainage spouts are provided around the circumference of the tray to allow water falling on the tray to drip onto the baffle plate.

7. The exhaust stack pipe as claimed in claim 1, further comprising a heat shield surrounding the stack pipe over at least the majority of its circumference, wherein the cover pipe is formed of the same diameter as such a heat shield.

8. An exhaust stack pipe, comprising:

a stack pipe including an upper end and lateral openings adjacent the upper end, a curved cover pipe of greater diameter than the stack pipe overlying the lateral openings and shaped to prevent rain from falling directly onto the upper end of the stack pipe, a flow diverter of lesser diameter than the cover pipe mounted within the cover pipe to overlie the end of the stack pipe, the flow diverter comprising an extension tube having lateral openings, a tapering deflector extending into the stack pipe to divert exhaust gases to flow into the cover pipe through the lateral openings in the stack pipe, and a flow restrictor provided within the exhaust stack upstream of the cover pipe to act as a venturi, wherein drainage holes are formed in the exhaust stack pipe around the flow restrictor.

* * * * *